US005279434A

United States Patent [19]

Aguirrezabal

[11] Patent Number: 5,279,434

[45] Date of Patent: Jan. 18, 1994

[54] TUBULAR CONTAINER WITH A NON-REMOVABLE WORKABLE CAP

[75] Inventor: Antonio Aguirrezabal, Vitoria, Spain

[73] Assignee: Tubolast Hispania S.A., Vitoria, Spain

[21] Appl. No.: 53,812

[22] Filed: Apr. 29, 1993

Related U.S. Application Data

[63] Continuation of Ser. No. 868,360, Apr. 14, 1992, abandoned.

[30] Foreign Application Priority Data

Aug. 26, 1991 [ES] Spain ..... 91.01530

[51] Int. Cl.[5] ..... B65D 41/04

[52] U.S. Cl. ..... 215/331; 215/216; 215/218; 215/330; 215/263; 222/39; 222/153; 222/549

[58] Field of Search ..... 215/263

[56] References Cited

U.S. PATENT DOCUMENTS

| | | | |
|---|---|---|---|
| 3,809,276 | 5/1974 | Landen | 215/332 |
| 3,917,097 | 11/1975 | Uhlig | 215/216 |
| 4,204,615 | 5/1980 | McCarthy | 222/153 |
| 4,335,823 | 6/1982 | Montgomery et al. | 215/216 |
| 4,376,497 | 3/1983 | Mumford | 222/153 |
| 4,572,385 | 2/1986 | Luker | 215/218 |
| 4,630,743 | 12/1986 | Wright | 215/216 |
| 4,756,435 | 7/1988 | Schick et al. | 222/153 |
| 4,781,311 | 11/1988 | Dunning et al. | 222/153 |
| 5,111,967 | 5/1992 | Schreiber | 222/39 |
| 5,145,080 | 9/1992 | Imbery, Jr. | 215/331 |
| 5,158,206 | 10/1992 | Kobayashi et al. | 222/39 |

FOREIGN PATENT DOCUMENTS

| | | | |
|---|---|---|---|
| 109493 | 10/1967 | Denmark | 215/331 |
| 0265243 | 4/1988 | European Pat. Off. . | |
| 0410922 | 1/1991 | European Pat. Off. . | |
| 1035476 | 7/1966 | United Kingdom . | |
| 1526226 | 9/1978 | United Kingdom . | |

*Primary Examiner*—H. Grant Skaggs
*Assistant Examiner*—Carol Lynn Druzbick
*Attorney, Agent, or Firm*—Browdy and Neimark

[57] ABSTRACT

A tubular container with a non-removable workable cap, by means of which the cap itself is provided with a limitation in its closure on the tube. To do this, the cap is equipped with a vertical rib (7) which originates from the front internal face of the cap and from its inner side surface, which is interrupted at a certain distance from the free end of the outer skirt (9) of the cap. This cap makes contact, when it is turned in both directions, with a protrusion (8) made on the tube and is limited in the closure position by an L-shaped protrusion (3) on the tube itself.

1 Claim, 1 Drawing Sheet

TUBULAR CONTAINER WITH A NON-REMOVABLE WORKABLE CAP

This application is a continuation of application Ser. No. 07/868,360, filed Apr. 14, 1992, now abandoned.

FIELD OF THE INVENTION

The invention relates to a tamper-proof non-removable workable cap for a tube container, in which the product from the container tube reaches the exterior through a hole in the front of the cap by turning the cap on the tube. Prior art caps of this kind for containers are known. One such cap has a tamper-proof device, limiting the opening of the cap by placing a stop on the tube which engages a rib on the cap. When the cap is further forcibly turned to gain access to the contents of the tube, the rib will break, indicating unauthorized opening of the tube.

In that cap, the rib on the inside of the cap flexes onto a stop on the tube when being closed, whereas on opening the cap, it engages the other face of the stop, thus preventing total opening.

SUMMARY OF THE INVENTION

The aim of the present invention is a safety cap for container tubes wherein the closure of the cap is limited while also performing a function of safeguarding the contents of the container when the cap is opened to dispense the contents of the tube.

In order to achieve the desired result, the cap on the container includes a radial internal rib. This internal rib is placed at a certain distance from a helicoidal fin on the cap which is intended to limit opening of the cap. The rib is made somewhat shorter than the said helicoidal fin.

A vertical protrusion of limited thickness and an opening stop are formed on the truncated cone shaped section of the tube to cooperate with the cap when it is turned in different directions.

Thus, the radial rib of the cap makes contact with the upper end of the protrusion on the tube when the cap is turned, in such a way that the protrusion flexes because of the said turning action, making an identifiable sound. This rib is situated near the fin for the opening stop.

When the cap is in its initial closed position, the radial vertical rib of the cap is situated between the opening stop and the vertical protrusion on the tube. When closing the cap further in this situation by turning clockwise, the vertical rib makes contact with one face of the cap opening stop, and indicates to the user an impediment which precludes further turning of the cap on the tube. This constitutes the closing limit for the container.

When the cap is in the closed position, and the user begins to open the cap by turning counterclockwise, the radial vertical rib makes contact with the upper edge of the vertical protrusion on the tube and the user is informed that opening of the container has begun by the sound made by the engagement of the rib on the cap against the protrusion on the tube. By continuing to turn the cap counterclockwise, the opening is stopped by means of the helicoidal fin on the cap, which engages an L-shaped recess in the stop on the tube.

The radial vertical rib in the cap is placed at a distance in a clockwise direction in relation to its helicoidal fin. On the contrary, the vertical protrusion on the tube is situated at a distance in a counterclockwise direction in relation to the opening stop of the cap.

The sequences and operations described here are defined in greater detail on the sheet of drawings which is attached, on which one non-restrictive option of the patent is shown.

PREFERRED EMBODIMENT OF THE INVENTION

Figure 1:
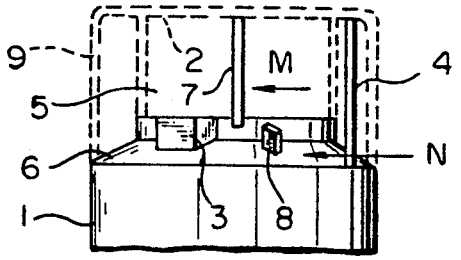
FIG. 1 is a side elevation of the cross-section of the cap for a container tube, with the cap shown by the dotted line.
Figure 2:
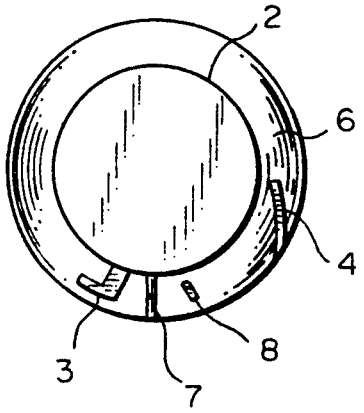
FIG. 2 is a top view of FIG. 1.

FIGS. 1 and 2 show a tube (1) and a cap (2) provided with an outer skirt (9) and an inner skirt (10) into which the screw-threaded neck (5) of the upper end of the tube (1) screws (threads not shown). FIGS. 1 and 2 show the positions of the helicoidal fin (4) fixed to the cap (2) and the opening stop (3) fixed on the tube (1). An L-shaped recess is formed on the clockwise side of opening stop (3) which engages the free edge of fin (4), thus limiting the opening of the cap.

FIGS. 1 and 2 also show the position of the radial vertical rib (7) of the cap (2) fixed on skirts (9 and 10). Rib (7) is situated in a short circumferential distance in relation to the helicoidal fin (4), while the flexible vertical protrusion (8) on the tube (1) is situated in a short circumferential distance in relation to the stop (3).

As shown in FIGS. 1 and 2, turning of the cap (2) counterclockwise will make the rib (7) fixed on the cap come into contact with the protrusion (8), which flexes and emits an identifiable noise in order to inform the user that the cap is being opened. When the cap is in the open position, an opening in the tube container (not shown) communicates with an opening on the cap (not shown) which permits dispensing of the contents of the tube. These openings are conventional and do not form a part of the claimed invention.

Figure 3:
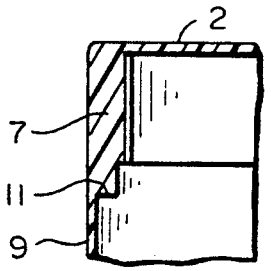
FIG. 3 is a vertical diametric cross-section of the cap at the radial vertical rib, seen in the direction of arrow (M) in FIG. 1.

As shown in FIG. 3, the rib (7) is fixed to the two skirts in the cap, the inner one and the outer one (9), and its lower end has a stepped section (11) which contacts the upper end of the protrusion (8) on the tube when the cap is turned.

Figure 4:
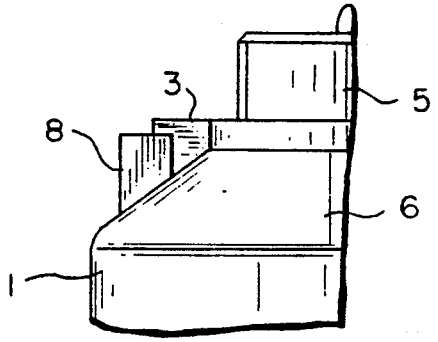
FIG. 4 is a side view of the upper end of the tube, seen in the direction of arrow (N) in FIG. 1.

The side positions of the vertical protrusion (8) and of the stop (3) on the tube (1) in the direction of arrow (N) on FIG. 1, is shown in FIG. 4. Both protrusions (8, 3) jut upwards from the trunco-conical area (6) of the tube (1).

The movements of the units have therefore been described, one corresponding to the technique of the prior art mentioned at the beginning of this specification and the other that of the present invention.

According to the prior art device, opening the cap clockwise results in a rib on a cap striking a stop which limits the opening of the cap and prevents it from being removed from the container unless the rib is broken.

According to the movements of the present invention, the action of opening the cap causes the radial rib (7) to contact and flex on the protrusion (8) creating an identifiable noise which indicates that the cap is being opened. When the cap is closed the rib flexes again on the protrusion (8) indicating that the cap is being closed, and comes up against the stop (3) itself on the tube (1), thus preventing excessive or forced closure which might make the container unusable.

What is claimed is:

1. The combination of a tubular container and a safety cap wherein said cap is threadedly engaged to said container in a manner maintaining said cap on said container when said cap is opened to dispense the contents of said container and positively limiting the point of closure of said cap on said container, said combination comprising;

a safety cap having a circular outer skirt and a concentric inner skirt spaced from said circular outer skirt;

a tubular container having a circular neck at an upper end of said container;

said inner skirt of said safety cap threadedly engaged on said circular neck of said tubular container;

said safety cap having a rib engaged between said outer skirt and said inner skirt and a helicoidal fin, spaced counterclockwise from said rib, engaged on a first edge to said outer skirt;

said helicoidal fin having a free second edge spaced opposite and counterclockwise from said first edge;

a vertical stop projecting up from a shoulder below said circular neck on said upper end of said container;

said vertical stop having a recess on a clockwise side of said stop and a flat face on a counterclockwise side of said stop, a vertical flexible projection projecting up from said shoulder and spaced counterclockwise from said vertical stop, when said safety cap is threadedly engaged on said tubular container, said rib projects downward between said vertical projections and said vertical stop and said free second edge of said helicoidal fin is engageable in said recess of said vertical stop, said vertical flexible projection being sufficiently long to contact said rib when said cap is turned on said tubular container and make an identifiable noise as said rib passes over said vertical flexible projection, wherein turning said rib counterclockwise on said container to gain access to the content of said tubular container results in said rib first contacting said vertical flexible projection signaling a user that said container is being opened and ending with said free second edge of said helicoidal fin engaged in said recess of said vertical stop thereby precluding removal of said cap from said tubular container, and wherein thereafter turning said rib clockwise on said container to close said container results in said rib first contacting said vertical flexible projection signaling a user that said container is being closed and ending with said rib abutting said flat face on said stop.

* * * * *